United States Patent [19]

Keller

[11] Patent Number: 4,923,035

[45] Date of Patent: May 8, 1990

[54] LOW-FREQUENCY MUFFLER

[75] Inventor: Jakob Keller, Dottikon, Switzerland

[73] Assignee: BBC Brown Boveri AG, Baden, Switzerland

[21] Appl. No.: 269,313

[22] Filed: Nov. 10, 1988

[51] Int. Cl.[5] ..... F01N 1/06; F01N 7/08

[52] U.S. Cl. ..... 181/228; 181/255; 181/268; 181/275

[58] Field of Search ..... 181/247–253, 181/259, 262, 263, 268, 269, 275, 228

[56] References Cited

U.S. PATENT DOCUMENTS

| | | | |
|---|---|---|---|
| 944,646 | 12/1909 | Xardell | 181/275 |
| 1,338,520 | 4/1920 | Moores | 181/253 |
| 1,966,620 | 7/1934 | Fluor, Jr. | 181/262 |
| 2,838,128 | 6/1958 | Kliewer, Sr. | 181/264 |
| 3,361,227 | 1/1968 | Kaari | 181/265 |
| 3,888,331 | 6/1975 | Wang | 181/253 |

FOREIGN PATENT DOCUMENTS

| | | |
|---|---|---|
| 1264864 | 3/1968 | Fed. Rep. of Germany . |
| 2363696 | 3/1978 | France . |
| 888853 | 2/1962 | United Kingdom . |

*Primary Examiner*—B. R. Fuller

*Attorney, Agent, or Firm*—Burns, Doane, Swecker & Mathis

[57] ABSTRACT

For the purpose of muffling low-frequency sound waves such as occur in components of fluid-flow engines, the muffler proposed here consists of a feed pipe (1) through which (3) and around which (4) a medium flows. At its end in the direction of flow, the feed pipe (1) has a row of muffling bore holes (2) distributed over the periphery, via which the medium (4) flowing around the feed pipe (1) flows into the interior of the feed pipe (1). The effective length L of the feed pipe (1), the cross-sectional area A of the feed pipe (1) and the total cross-sectional area B of the muffling bore holes form the geometric parameters for calculating an optimum muffling of the low-frequency sound waves.

1 Claim, 2 Drawing Sheets

LOW-FREQUENCY MUFFLER

BACKGROUND OF THE INVENTION

1. Field of the Invention

The present invention relates to a muffler for muffling low-frequency sound waves.

2. Discussion of Background

For numerous fluid-flow engines, or components of fluid-flow engines (combustion chambers, control valves, etc.), the impedance properties of flow feed lines, especially with regard to low-frequency natural acoustic vibrations of such components, play an important role in relation to their acoustic stability properties. Sound waves, which are radiated into feed lines, ought not to be reflected, or to be reflected at most to a slight extent. Otherwise, the reflected waves can contribute to the excitation of strong resonant vibrations. As a rule, the effective muffling of high-frequency sound waves can be achieved with simple technical arrangements (e.g. employment of a classical muffler: perforated sheet above a small closed cavity). By contrast, the muffling of low-frequency sound waves is disproportionally more difficult. A current technique consists in coupling large Helmholz resonators to the feed lines. However, the disadvantage of such a measure consists in that such muffling resonators take up a lot of space and are correspondingly elaborate and expensive. Moreover, the frequency bandwidth of the muffling is very small, and the muffling effect is weak, even in the optimum frequency band.

SUMMARY OF THE INVENTION

The invention is intended to provide a remedy for this. It is the object of the invention, as characterised in the claims, to achieve the muffling of a broad frequency band in the smallest space with a muffler of the type named at the beginning.

The essential advantage of the invention is to be seen in that with the aid of such mufflers it is also possible strongly to muffle waves, the wavelength of which is substantially greater than the four-fold length of the feed pipe between pipe inlet and row of holes.

Moreover, whereas normal mufflers, such as are to be encountered in the exhaust pipes of internal combustion engines as Helmholz resonators, for example, the absorbtion varies quadratically with the sound wave aptitude, there being no flow through the bore holes provided there in the non-vibrating case, with the object according to the invention the absorbtion varies in a manner proportional to the aptitude, and there is flow through the muffling bore holes in the non-vibrating case.

This means that the present invented object acts as absorber for the particularly designed frequency within a muffling bandwidth of approximately one octave.

A further advantage of the invention is to be seen in that owing to its simple and space-saving form the muffler can be integrated at any time with only slight modifications into all possible fluid-flow engines, and this also as a retrofit measure.

Advantageous and expendient developments of the achievement of object according to the invention are characterised in the subordinate claims.

BRIEF DESCRIPTION OF THE DRAWINGS

A more complete appreciation of the invention and many of the attended advantages thereof will be readily obtained as the same becomes better understood by reference to the following detailed description when considered in connection with the accompanying drawings, wherein.

DESCRIPTION OF THE PREFERRED EMBODIMENTS

Figure 1:
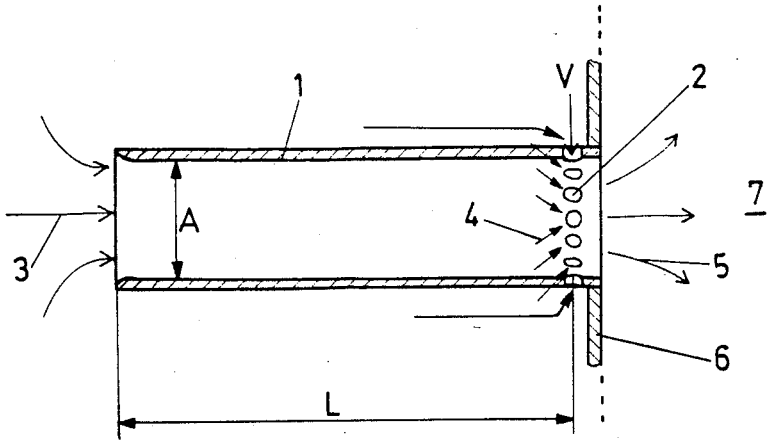
FIG. 1 shows a muffler.

Referring now to the drawings, wherein like reference numerals designate identical or corresponding parts throughout the several views, in FIG. 1 the muffler consists of a feed pipe 1 through which 3 and around which 4 a medium flows. At a length L from the pipe inlet, this pipe has a row of muffling bore holes 2 distributed over the periphery, through which a part 4 of the medium brought up flows in the interior of the feed pipe 1, and collides there with the medium 3 flowing through the feed pipe. Thereupon, the medium 5 leaves the feed pipe 1 and enters into a fluid-flow engine not represented. A present medium is specifically a gas; it will often be air. The wall 6 is designed to indicate that the feed pipe 1 forming the muffler can communicate directly with the combustion chamber 7 of the fluid-flow engine not represented. Of course, the feed pipe 1 can be mounted on a premixing element. Whether it is necessary to have a change of cross-section, for example by means of a Borda step, at the transition between feed pipe 1 and the premixing element not represented, depends on the type of the combustion chamber. Moreover, it happens that for reasons of space a burner, which is, for its part, connected ahead of the combustion chamber, can immediately follow the feed pipe 1. In terms of the body, it is striking that the feed pipe 1 is characterised by only three geometric quantities, namely by the cross-sectional area A of the feed pipe 1 by the effective length L of the feed pipe, which extends in the direction of flow from the pipe inlet to the centre of the muffling bore holes 2 and by the total cross-section B of all muffling bore holes 2 on the hole circle. Further parameters for the optimum design of a muffler are, in addition, the rate of flow V through the muffling bore holes 2 and the sound velocity C of the medium itself. In principle, the rate of flow V also depends on the size of the individual muffling bore holes 2. On the other hand the dimensioning and number of the muffling bore holes 2 depends on the cross-sectional area A of the feed pipe 1. Mathematically, the total cross-section B of the muffling bore holes 2 is determined by $$B = n \cdot \pi \cdot \frac{d_L^2}{4} \tag{1}$$

where n denotes the number of openings, and $d_L$ their diameter.

Since, in practice, the cross-sectional area A and the effective length L of the feed pipe 1 are predetermined from the system specifications, it is chiefly the total cross-section B of all muffling bore holes 2 which is left for the optimum design of the muffler. The number of their muffling bore holes 2 distributed on the periphery, and their diameter, depend, in this connection on the size of the feed pipe 1. The optimization must, in this connection, take into consideration that the through-flow rate V in the muffling bore holes 2 and the second velocity c of the medium also play a role as further parameters. Expressed as a percentage of the radiated power, the acoustic power of the sound wave of frequency f scattered by the muffler amounts to $$\frac{1 + (1 - \alpha)^2 \cdot \beta^2}{1 + (1 + \alpha)^2 \cdot \beta^2} \times 100\% \quad (2)$$

where $$\alpha = \frac{B}{A} \cdot \frac{c}{V} \quad (2a)$$

and $$\beta = \tan\left(\frac{2\pi fL}{c}\right) \quad (2b)$$

In this connection, the total cross-sectional B of the muffling bore holes is to be chosen so that the parameter $\alpha$ attains its optimal value $_{OPTIMAL}$:

$$\alpha_{OPTIMAL} = \left[1 + \frac{1}{\beta 2}\right]^{\frac{1}{2}} \quad (3)$$

By substituting the value of the $\alpha_{OPTIMAL}$ so obtained in equation (2) a calculation is then made of the percentage power of the wave reflected by the muffler for the particular case and issue.

Figure 2:
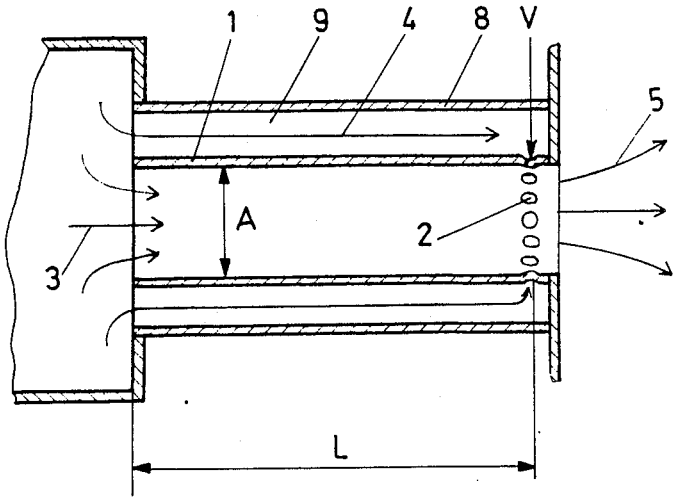
FIG. 2 shows a further embodiment of a muffler.

FIG. 2 shows a further variant embadiment of the muffler, in which the aerofaction 4 is led to the muffling bore holes 2 through an annular opening 9, which extends the entire length of the feed pipe 1. To this end, a second pipe 8 is provided concentrically to the feed pipe 1. The distance of the second pipe 8 from the feed pipe 1 depends on the amount determined for the air fraction 4 and also on the rate which is aimed at for the flow V through the muffling bore-holes 2.

Figure 3:
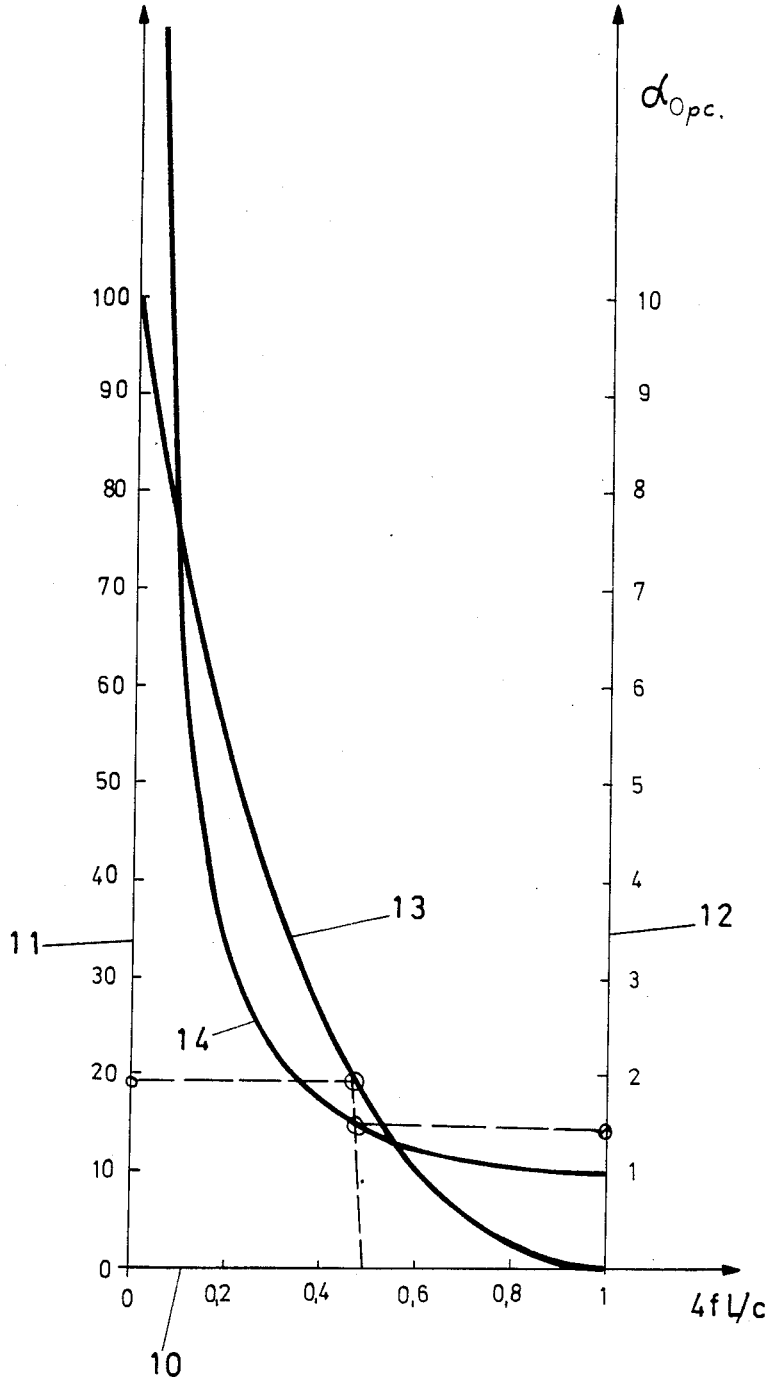
FIG. 3 shows the graphical acquisition of the optimum muffling property

FIG. 3 show a graphical representation from which it is possible to read off $\alpha_{OPTIMAL}$ and the associate percentage power of the waves reflected by the muffler. The abscissa 10 with the Term 4 fl/C represents the phase, i.e. that length of the muffler, which represents the ideal length at the value 1 on the Abscissa 10. The ordinate 11 is used to plot the power, in %, of the wave reflected by the muffler, with reference to the incoming wave, i.e. to the wave which is excited in the combustion chamber, and is radiated into the muffler. The other ordinate 12 represents $\alpha_{OPTIMAL}$. As already explained above, contained in a weighted fashion in this value is the total cross-sectional area B of the muffling bore holes 2. The curve 13 describes the decreasing part in % of the wave reflected by the muffler, as a function of an increasing phase (4 fl/C). The other curve 24 describes the increasing value of $\alpha_{OPTIMAL}$ for decreasing phase (4fl/C). It can be seen clearly in the graph how for the ideal value 1 (ideal length) of the muffler, $\alpha$ the power in % of the wave reflected by the muffler amounts to 0 i.e. in such a case a total absorption would have been achieved.

However, in practice, it is often the case that especially when a muffler has been retrofitted, that a decreased phase must be selected. If the fitting conditions are such that, e.g. only 50% of the theoretical ideal length of the muffler can be selected, then this corresponds to an $\alpha_{OPTIMAL}$ of approximately 1.40 $\alpha$ (vertical point of intersection with curve 14). If this value is substituted in formula (2a), it is possible to calculate the total cross-sectional area B of the muffling bore holes 2 for a predetermined cross-sectional area A of the feed pipe 1. The other point of intersection with curve 14 yields the % power of the wave reflected by the muffler; in our case this corresponds to approximately 19%, which still represents an almost total absorption. As an introductory aid to the use of the graph according to FIG. 3, the example adopted is plotted in the form of the dashed lines in the graph.

Obviously numerous modifications and variations of the present invention are possible in the light of the above teachings. It is therefore to be understood that within the scope of the appended claims, the invention may be practised otherwise than specifically described herein.

What is claimed as new and desired to be secured by Letters Patent of the United States is:

1. A muffler for muffling low-frequency sound waves comprising a hollow feed pipe having an inlet, and a plurality of muffling bore holes distributed over a periphery of said feed pipe at approximately a distance L from said feed pipe inlet, said plurality of bore holes providing access for a medium flow into said feed pipe, said plurality of bore holes having a total cross-sectional area B such that:

$$B = \frac{AV}{C}\left(\frac{1}{\beta^2} + 1\right)^{\frac{1}{2}}$$

where $$\beta = \tan\left(\frac{2\pi fL}{c}\right).$$

and

A = Cross-sectional area of the feed pipe c = Sound velocity of the medium f = Frequency of the sound wave.

L = Effective length of the feed pipe from said pipe inlet to said bore holes.

V = Rate of flow through the muffling bore holes.

* * * * *

UNITED STATES PATENT AND TRADEMARK OFFICE

CERTIFICATE OF CORRECTION

PATENT NO. : 4,923,035

DATED : May 8, 1990

INVENTOR(S) : Jakob Keller

It is certified that error appears in the above-identified patent and that said Letters Patent is hereby corrected as shown below:

On the title page Insert

--[30] Foreign Application Priority Data

Nov. 18, 1987 [CH] Switzerland No. 4494/87-4 --.

Signed and Sealed this

Seventeenth Day of September, 1991

*Attest:*

HARRY F. MANBECK, JR.

*Attesting Officer*

*Commissioner of Patents and Trademarks*